US011013320B2

(12) United States Patent
Meusburger et al.

(10) Patent No.: US 11,013,320 B2
(45) Date of Patent: May 25, 2021

(54) DRAWER PULL-OUT GUIDE

(71) Applicant: Julius Blum GmbH, Hoechst (AT)

(72) Inventors: Marc Meusburger, Egg (AT); David Ruech, Sautens (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/749,274

(22) Filed: Jan. 22, 2020

(65) Prior Publication Data

US 2020/0154885 A1 May 21, 2020

Related U.S. Application Data

(63) Continuation of application No. PCT/AT2018/060143, filed on Jul. 10, 2018.

(30) Foreign Application Priority Data

Aug. 17, 2017 (AT) ..... A 50683/2017

(51) Int. Cl.
*A47B 88/467* (2017.01)
*A47B 88/49* (2017.01)

(52) U.S. Cl.
CPC ..... *A47B 88/467* (2017.01); *A47B 88/49* (2017.01)

(58) Field of Classification Search
CPC ..... A47B 88/467; A47B 88/49; A47B 88/50; A47B 88/477; A47B 88/427; A47B 88/40
See application file for complete search history.

(56) References Cited

U.S. PATENT DOCUMENTS

| | | | | |
|---|---|---|---|---|
| 5,564,807 | A | 10/1996 | Röck et al. | |
| 7,654,625 | B2 * | 2/2010 | Amann | A47B 88/427 312/334.44 |
| 7,731,311 | B2 * | 6/2010 | Lam | A47B 88/467 312/333 |
| 9,693,627 | B2 * | 7/2017 | Chen | A47B 88/403 |
| 10,470,570 | B2 * | 11/2019 | Chen | A47B 88/49 |
| 10,653,240 | B2 * | 5/2020 | Goetz | E05F 1/16 |

(Continued)

FOREIGN PATENT DOCUMENTS

| | | |
|---|---|---|
| AT | 009 972 | 7/2008 |
| CN | 104997304 | 10/2015 |

(Continued)

OTHER PUBLICATIONS

English translation of Search Report dated Mar. 18, 2019 in Taiwanese Application No. 107125462.

(Continued)

*Primary Examiner* — Hanh V Tran
(74) *Attorney, Agent, or Firm* — Wenderoth, Lind & Ponack, L.L.P.

(57) ABSTRACT

A drawer pull-out guide includes a carcass rail to be fixed to a furniture carcass, an extension rail displaceably supported relative to the carcass rail between a closed position and an open position, a retraction device having a force storage member, and a functional unit arranged on a front-end region of the extension rail. The extension rail can be retracted into the closed position by a force of the force storage member. The retraction device is at least partially arranged within the extension rail. The functional unit and the retraction device are configured as constructional units separate from one another.

20 Claims, 11 Drawing Sheets

(56) References Cited

U.S. PATENT DOCUMENTS

| | | | | |
|---|---|---|---|---|
| 10,667,608 | B2 * | 6/2020 | Rehage | E05F 3/00 |
| 10,758,043 | B2 * | 9/2020 | Pohlmann | A47B 88/467 |
| 2004/0201339 | A1 * | 10/2004 | Dickson | A47B 88/40 312/334.45 |
| 2004/0245898 | A1 | 12/2004 | Amann et al. | |
| 2008/0303397 | A1 * | 12/2008 | Chen | A47B 88/427 312/334.46 |
| 2010/0027923 | A1 * | 2/2010 | Bonat | A47B 88/493 384/55 |
| 2010/0231107 | A1 * | 9/2010 | Radusin | A47B 88/467 312/319.1 |
| 2011/0037362 | A1 * | 2/2011 | Park | A47B 88/467 312/319.1 |
| 2011/0037366 | A1 * | 2/2011 | Lam | A47B 88/467 312/334.44 |
| 2011/0043087 | A1 * | 2/2011 | Shih | A47B 88/467 312/334.1 |
| 2012/0002907 | A1 * | 1/2012 | Rehage | A47B 88/467 384/20 |
| 2013/0119843 | A1 * | 5/2013 | Breisacher | A47B 88/467 312/334.47 |
| 2013/0182978 | A1 * | 7/2013 | Huang | A47B 88/467 384/21 |
| 2014/0015390 | A1 * | 1/2014 | Grabherr | A47B 88/407 312/334.4 |
| 2014/0021840 | A1 * | 1/2014 | Radusin | A47B 88/467 312/319.1 |
| 2014/0055020 | A1 * | 2/2014 | Gasser | A47B 88/427 312/333 |
| 2015/0289648 | A1 * | 10/2015 | Bachor | A47B 88/453 312/334.46 |
| 2016/0106212 | A1 * | 4/2016 | Grabher | A47B 88/443 312/334.7 |
| 2016/0198855 | A1 * | 7/2016 | Liang | A47B 88/427 248/241 |
| 2017/0086583 | A1 * | 3/2017 | Chen | A47B 88/463 |
| 2017/0095080 | A1 * | 4/2017 | Chen | H05K 7/183 |
| 2017/0135476 | A1 * | 5/2017 | Chen | A47B 88/407 |
| 2017/0172300 | A1 * | 6/2017 | Bowman | A47B 88/487 |
| 2018/0306236 | A1 * | 10/2018 | Liu | A47B 88/49 |
| 2020/0170410 | A1 * | 6/2020 | Meusburger | A47B 88/493 |
| 2020/0187649 | A1 * | 6/2020 | Meusburger | F16C 29/045 |

FOREIGN PATENT DOCUMENTS

| | | |
|---|---|---|
| DE | 20 2007 007 773 | 10/2007 |
| DE | 20 2008 012 996 | 3/2010 |
| DE | 10 2010 017 132 | 12/2011 |
| EP | 0 664 984 | 8/1995 |
| EP | 1 483 984 | 12/2004 |
| EP | 1 690 472 | 8/2006 |
| TW | M292326 | 6/2006 |

OTHER PUBLICATIONS

English translation of Search Report dated Sep. 5, 2019 in Taiwanese Application No. 107125462.

International Search Report dated Aug. 23, 2018 in International (PCT) Application No. PCT/AT2018/060143.

Search Report dated Jan. 21, 2021 in Chinese Patent Application No. 201880052766.0.

* cited by examiner

DRAWER PULL-OUT GUIDE

BACKGROUND OF THE INVENTION

1. Field of the Invention

The present invention relates to a drawer pull-out guide, comprising:

- a carcass rail to be fixed to a furniture carcass,
- at least one extension rail displaceably supported relative to the carcass rail between a closed position and an open position,
- a retraction device having at least one force storage member, wherein the extension rail can be retracted into the closed position by a force of the at least one force storage member, wherein the retraction device, for the most part, is arranged within the extension rail,
- a functional unit arranged on a front-end region of the extension rail.

The invention further concerns a drawer comprising at least one drawer pull-out guide of the type to be described, and an item of furniture having such a drawer.

2. Description of the Related Art

EP 1 483 984 A1 discloses a drawer pull-out guide having a carcass rail and a drawer rail displaceable relative thereto, and a functional unit is accommodated in a front-end region of the drawer rail. In this functional unit, a plurality of functions is integrated, for example a holder for a retraction device for retracting the drawer rail into a closed position, a holder for a damping device for damping a movement of the drawer rail into the closed position, a side centering device for compensating for a clearance between the extension rail and the drawer, or an end stop for stopping a movement of a closing movement of the extension rail relative to the carcass rail. The functional unit is arranged, with a cross-section adapted to the drawer rail, within the drawer rail or in an extension region of the drawer rail. As a result, due to the plurality of functions, restricted space situations arise. Moreover, in the case of a defect of one function, the entire functional unit has to be replaced.

SUMMARY OF THE INVENTION

It is an object of the present invention to propose a drawer pull-out guide mentioned in the introductory part, thereby avoiding the drawbacks as discussed above.

According to the invention, it is thus provided that the functional unit and the retraction device are configured as constructional units separate from one another.

In this way, there is the possibility that the retraction device can be arranged on various depth positions of the extension rail, independently from the functional unit. This is, in particular, advantageous with different nominal lengths of the drawer pull-out guide. With a length spectrum of the drawer pull-out guide to be covered, for example with a nominal length between 250 mm and 600 mm, there is an increased installation space available in order for the retraction device to be variably arranged. Moreover, the functional unit, due to the spatial separation from the retraction device, can be equipped with additional functionalities.

According to an embodiment, it can be provided that the functional unit can be configured as a one-piece component. Thereby, the functional unit can be formed as a molded plastic portion, whereby a simple and economic manufacture in serial production can be brought about.

The functional unit can thereby be arranged on a front-end region of the extension rail and can be arranged, for the most part (i.e. more than 50% of the constructional volume of the functional unit), within the extension rail. An advantageous arrangement is then provided if the functional unit covers a front face of the extension rail. In this way, a possibly provided sharp-edged front face of the extension rail can be covered, so that the danger of injuries can be largely prevented.

According to an embodiment, it can be provided that the functional unit

- includes at least one end stop for stopping a movement of the extension rail relative to the carcass rail in a direction of the closed position, wherein it is preferably provided that the end stop protrudes transversely from the extension rail and abuts against a counterstop of the carcass rail in the closed position, and/or

- includes at least one coupling device for coupling the extension rail to a drawer, wherein it is preferably provided that the coupling device includes at least coupling portion which, in a mounted condition of the drawer on the extension rail, engages into a recess of a carrier rail connected to the drawer, and/or

- includes at least one compensation device for compensating for a malposition, deviating from a predetermined relative position, of the at least one extension rail and/or of a running carriage of the drawer pull-out guide, wherein it is preferably provided that the compensation device includes at least one abutment portion by which an actuating device of the compensation device can be actuated, wherein the actuating device of the compensation device compensates for the malposition upon an actuation by the abutment portion, and/or

- includes a device for a relative, preferably lateral, positioning of the drawer relative to the extension rail, wherein it is preferably provided that the device includes at least one protrusion configured to bear against a carrier rail connected to the drawer, and/or

- includes a lift-off protection device for preventing or limiting a movement of the drawer in a height direction when the drawer is in a mounted condition on the extension rail, wherein it is preferably provided that the lift-off protection device includes at least one recess into which a holding nose of a carrier rail connected to the drawer engages when the drawer is in a mounted condition on the extension rail.

According to an embodiment, a damping device for damping a movement of the extension rail into the closed position can be provided. The, preferably hydraulic, damping device, together with the retraction device, can be combined in a common constructional unit. For example, the damping device can include a piston-cylinder-unit. Alternatively, the damping device can include a rotational damper, and a pinion of the rotational damper can be driven by a cooperation with a toothed rack.

BRIEF DESCRIPTION OF THE DRAWINGS

Further details and advantages of the present invention will be explained with the aid of the following description of figures, in which.

DETAILED DESCRIPTION OF THE INVENTION

Figure 1:
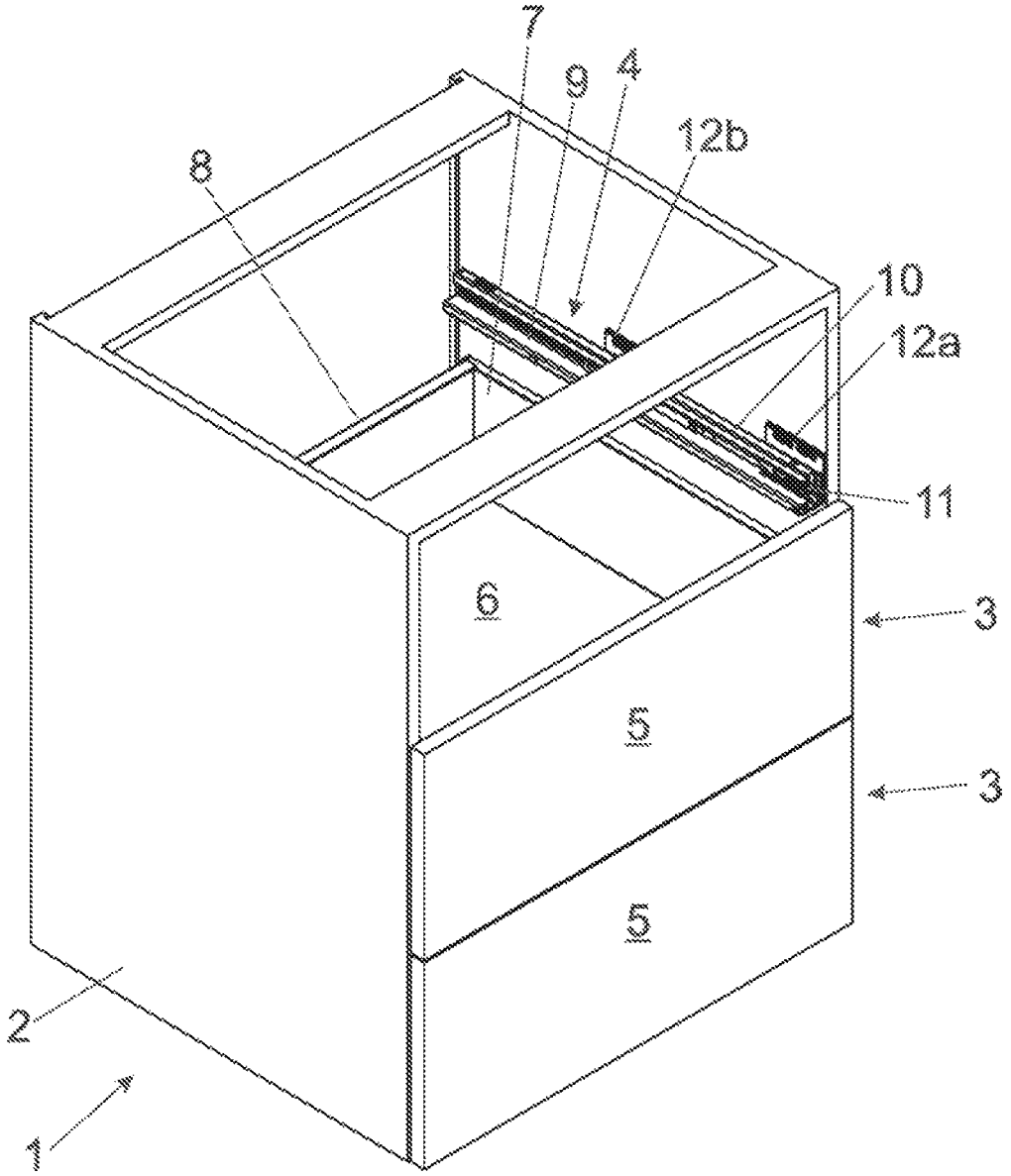
FIG. 1 shows a perspective view of an item of furniture having a furniture carcass and drawers configured to be displaceable thereto.

FIG. 1 shows an item of furniture 1 having a cupboard-shaped furniture carcass 2, and drawers 3 are displaceably supported relative to the furniture carcass 2 by drawer pull-out guides 4. Each of the drawers 3 includes a front panel 5, a drawer bottom 6, sidewalls 7 and a rear wall 8. Each of the drawer pull-out guides 4 includes a carcass rail 9 configured to be fixed to the furniture carcass 2 by fastening portions 12*a*, 12*b*, and at least one extension rail 10 displaceable relative to the carcass rail 9, and the extension rail 10 is to be connected to the sidewall 7. Optionally, a central rail 11 may be provided, the central rail 11 being displaceable between the carcass rail 9 and the extension rail 10 in order for the drawer 3 to be fully extended.

Figure 2:
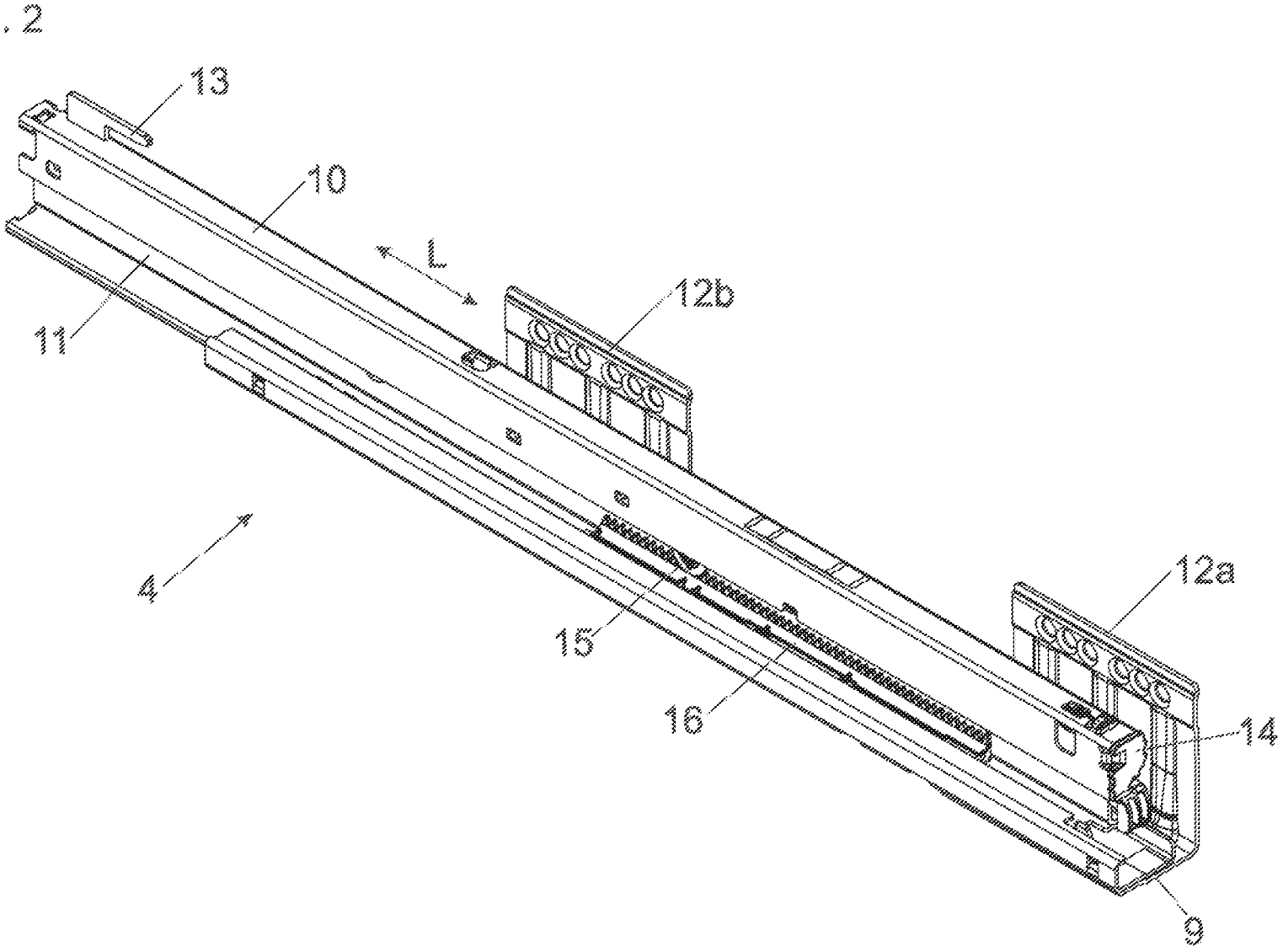
FIG. 2 shows a drawer pull-out guide in a perspective view.

FIG. 2 shows a drawer pull-out guide 4 in a perspective view, in which the carcass rail 9 is to be fixed to the furniture carcass 2 via the fastening portions 12*a*, 12*b*. The extension rail 10 is displaceable relative to the carcass rail 9, the extension rail 10 having a hook portion 13 on a rear end, and the hook portion 13 engages in a pre-drilled bore of the rear wall 8 in a mounted condition of the drawer 3. Therefore, a displacement of the rear end portion of the drawer 3, in a direction transverse to the longitudinal direction (L) of the extension rail 10, can be prevented or limited. Moreover, a functional unit 14 is arranged on the front-end region of the extension rail 10. The functional unit 14 is, for the most part, accommodated within the extension rail 10 for the sake of a compact construction. The extension rail 10, in a cross-section, has a U-shaped profiled portion, and a shape of the functional unit 14 is at least sectionally adapted to the U-shaped profiled portion of the extension rail 10. It can be recognized that the functional unit 14, preferably a plate-shaped portion of the functional unit 14, covers the front-end portion of the extension rail 10, whereby the danger of injuries due to a present sharp-edged front face of the extension rail 10 can be prevented. The central rail 11 is displaceably arranged between the carcass rail 9 and the extension rail 10. By a pinion 15 rotatably arranged on the central rail 11, a movement of the extension rail 10 relative to the central rail 11 can be controlled. The pinion 15, on the one hand, cooperates with a first tooth arrangement 42*a* (FIG. 9*a*) of a first running carriage 42, the first running carriage 42 being arranged between the carcass rail 9 and the central rail 11. On the other hand, the pinion 15 cooperates with a second toothed rack of a second running carriage 21 (FIG. 3), the second running carriage 21 being displaceably arranged between the central rail 11 and the extension rail 10. In this way, the extension rail 10 can be moved with a higher, preferably approximately a double, speed than the central rail 11 in the longitudinal direction (L).

Figure 3:
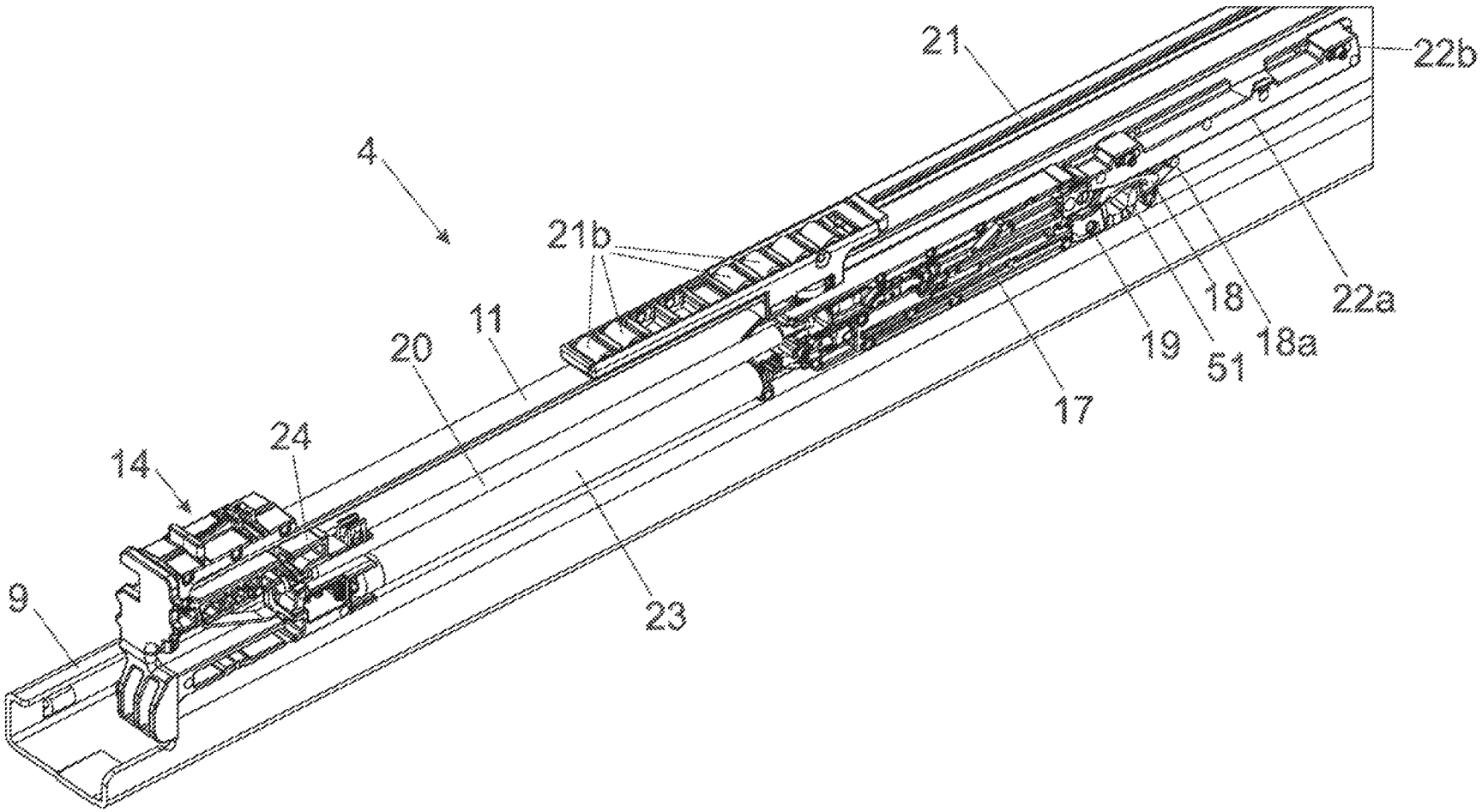
FIG. 3 shows a front-end region of the drawer pull-out guide with the extension rail hidden.

FIG. 3 shows a front-end region of the drawer pull-out guide 4 in the closed position, and the extension rail 10 is hidden for the sake of improved overview. By a retraction device 17 having at least one force storage member 20, preferably having at least one tension spring, the extension rail 10 can be retracted into the closed position. The retraction device 17 is fixed to the extension rail 10 and includes a movably-mounted entrainment member 18 which is pre-stressed by the force storage member 20 in a direction of the closed position, and the entrainment member 18 is configured to be displaced along a linear guide track 22*a* by a guide element 18*a*. In the shown closed position of the drawer pull-out guide 4, the entrainment member 18 is releasably coupled to a coupling element 51 arranged on the carcass rail 9. Upon opening the extension rail 10, the guide element 18*a* of the entrainment member 18 is moved along the linear guide track 22*a*, whereby the force storage member 20 is loaded. Subsequently, the entrainment member 18 is tilted due to the cooperation of the guide element 18*a* with a section 22*b* configured to be bent or edged from the linear guide track 22*a*, so that the entrainment member 18 is held in the section 22*b* in a self-locking ready position in which the force storage member 20 is loaded and the coupling element 51 is being released. Subsequently, the extension rail 10 can be further displaced in a direction of the open position in an uncoupled manner from the retraction device 17. Upon a closing movement of the extension rail 10, the entrainment member 18 is released from the ready position by the coupling element 51, whereupon the entrainment member 18 coupled to the coupling element 51 (and therewith the extension rail 10), can be retracted into the closed position by a force of the force storage member 20. For damping that spring-assisted retraction movement of the extension rail 10, a damping device 23 is provided. In the shown embodiment, the damping device 23 includes a, preferably hydraulic, piston-cylinder-unit. The force storage member 20 configured as a tension spring and the housing, in particular the cylinder, of the damping device 23 are jointly supported on a bearing portion 24 fixed to the extension rail 10, and the bearing portion 24 and the functional unit 14 are configured as components separate from one another. Moreover visible is the second running carriage 21 having a plurality of rolling bodies 21*b* spaced from one another in a longitudinal direction, the second running carriage 21 being displaceable between the central rail 11 and the extension rail 10.

Figure 4A:
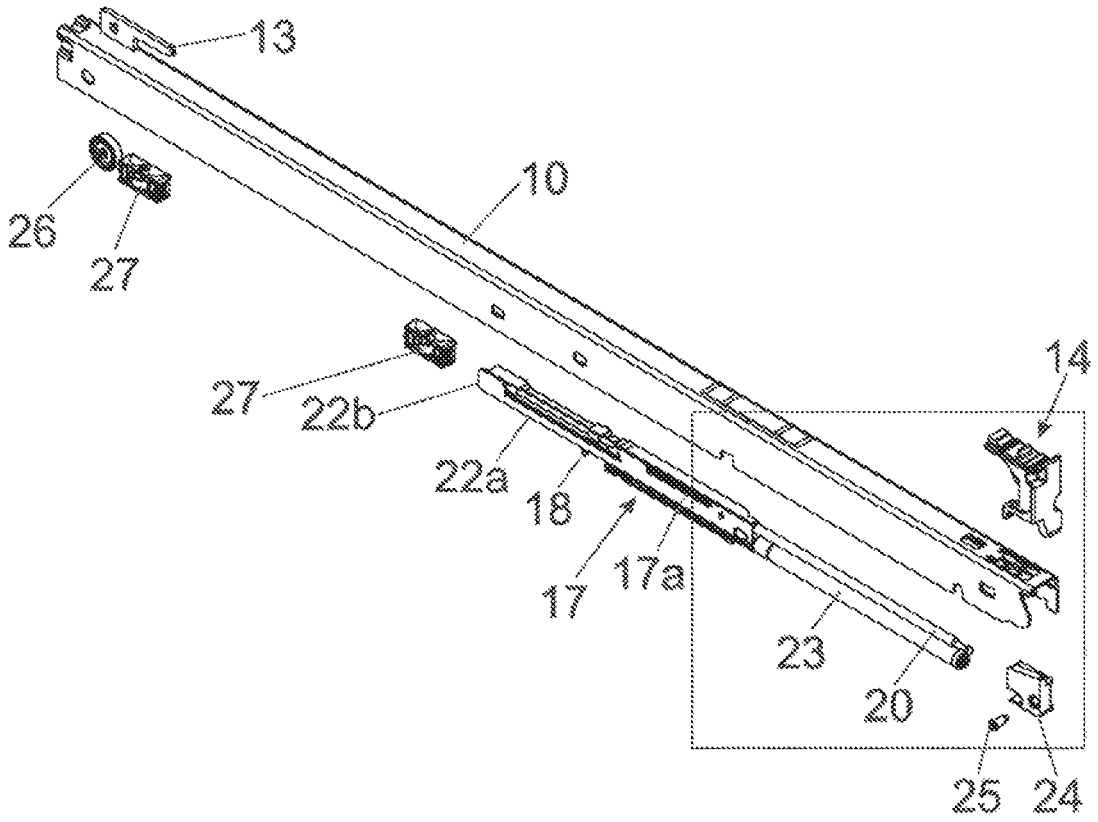
FIG. 4*a*, 4*b* show a perspective view of the extension rail with the retraction device and the functional unit, and an enlarged detail view thereof.

FIG. 4*a* shows the extension rail 10, in which the retraction device 17 as well as the functional unit 14 configured to be separate therefrom are accommodated, for the most part (i.e. with more than 50% of the constructional volume), within a, for example U-shaped, profiled section of the extension rail 10. The retraction device 17 includes a housing 17*a* on which the linear guide track 22*a* and the section 22*b* bent or edged therefrom are arranged or formed, the linear guide track 22*a* and the section 22*b* being provided for guiding the entrainment member 18. By a running wheel 26 arranged on the extension rail 10, the extension rail 10 can be supported relative to the central rail 11 in a vertical direction. By side rollers 27, the extension rail 10 can be guided relative to the central rail 11 in a lateral direction. The housing of the damping device 23 and the force storage member 20 in the form of the tension spring are, on the one hand, supported with one end on the housing 17*a* of the retraction device 17 and, on the other hand, supported on the bearing portion 24 to be fixed to the extension rail 10. The bearing portion 24, in the mounted position, is accommodated within the extension rail 10 and can be fixed, for example, by at least one pin 25 to a side limb of the extension rail 10.

Figure 4B:
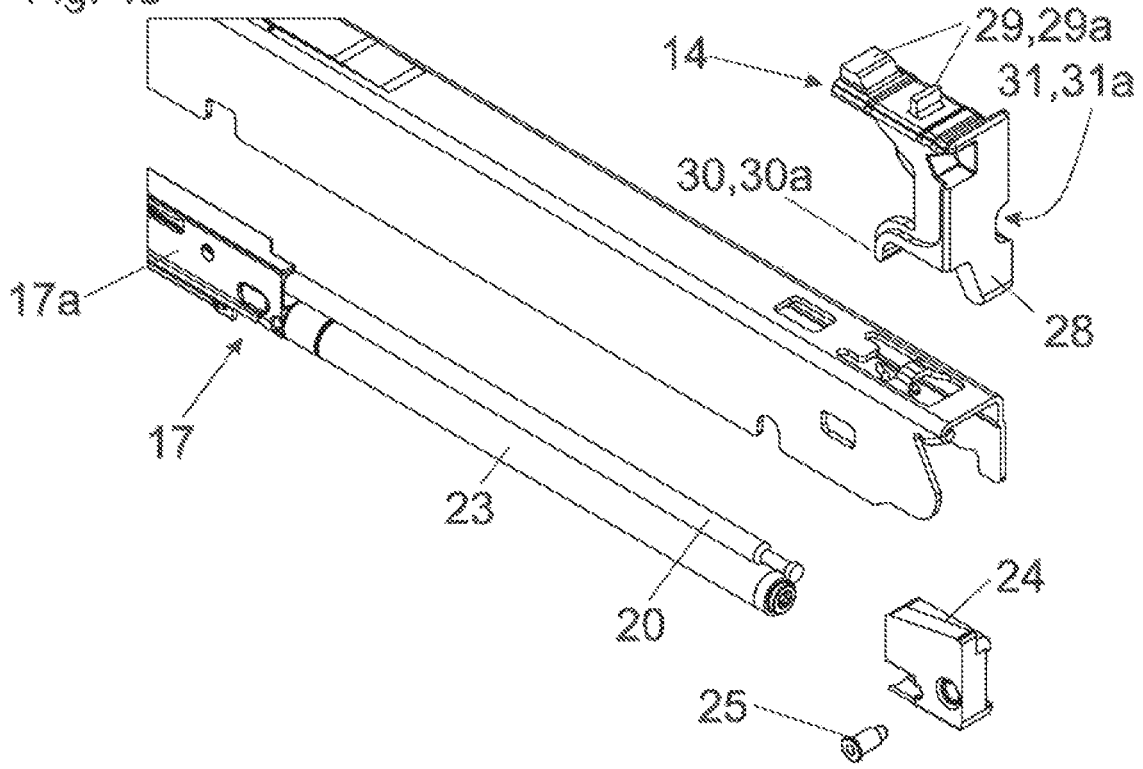

FIG. 4*b* shows the framed region according to FIG. 4*a* in an enlarged view. In the shown embodiment, the functional unit 14 is configured as a one-piece component made of plastic, and the functional unit 14

- includes at least one end stop 28 for stopping a movement of the extension rail 10 relative to the carcass rail 9 in a direction of the closed position, wherein it is preferably provided that the end stop 28 protrudes transversely from the extension rail 10 and is configured to abut against a counterstop 9*a* (FIG. 5*b*) of the carcass rail 9 in the closed position,
- includes at least one coupling device 29 for coupling the extension rail 10 to the drawer 3, wherein it is preferably provided that the coupling device 29 includes at least one coupling portion 29*a* which, in a mounted condition of the drawer 3 on the extension rail 10, engages into a recess of a carrier rail 35 (FIG. 6*a*) connected to the drawer 3,
- includes at least one compensation device 30 for compensating for a malposition, deviating from a predetermined relative position, of the at least one extension rail 10 and/or of a running carriage 21 of the drawer pull-out guide 4, wherein it is preferably provided that the compensation device 30 includes at least one abutment portion 30*a* configured to actuate an actuating device 33 of the compensation device 30, wherein the actuating device 33 of the compensation device 30 compensates for the malposition upon an actuation by the abutment portion 30*a*,
- includes a lift-off protection device 31 for preventing or limiting a movement of the drawer 3 in a height direction when the drawer 3 is in a mounted condition on the extension rail 10, wherein it is preferably provided that the lift-off protection device 31 includes at least one recess 31*a* into which a holding nose 36 (FIG. 6*b*) of a carrier rail 35 connected to the drawer 3 engages when the drawer 3 is in the mounted condition on the extension rail 10.

Figure 5A:
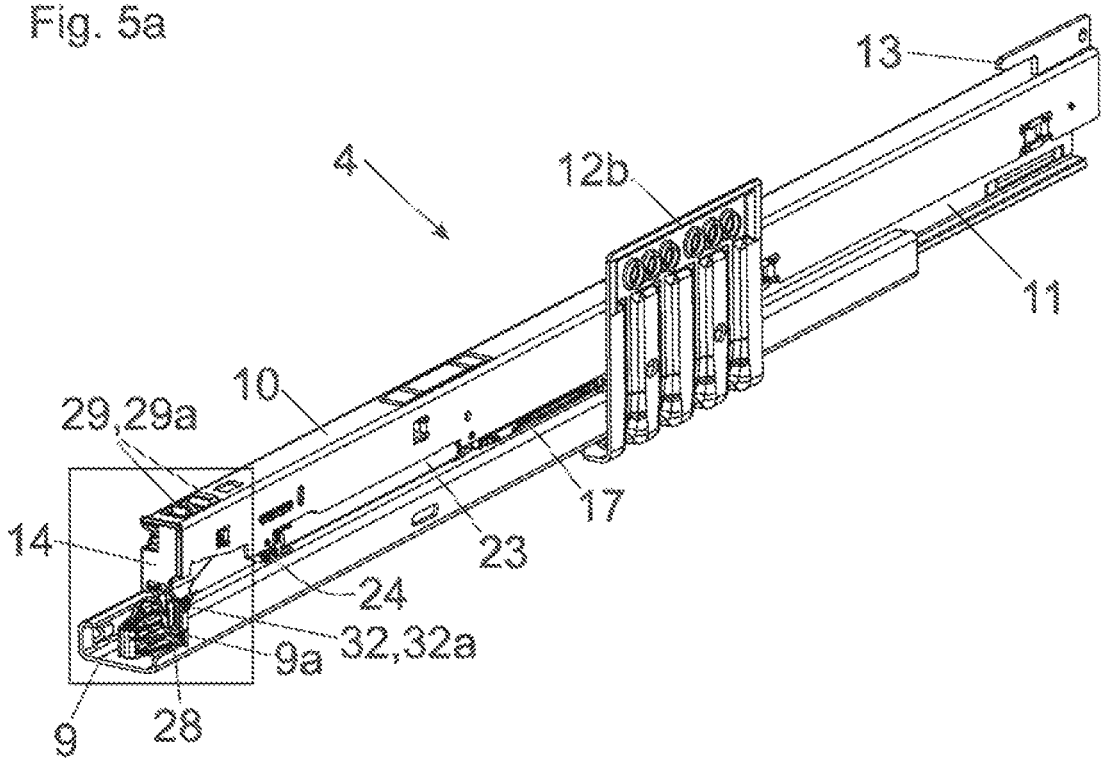
FIG. 5*a*, 5*b* show a perspective view of the drawer pull-out guide and an enlarged detail view thereof.

FIG. 5*a* shows the drawer pull-out guide 4 in a closed position, in which the end stop 28 of the functional unit 14 bears against a counterstop 9*a*, preferably a front face, of the carcass rail 9, so that a movement of the extension rail 10 relative to the carcass rail 9 in a direction of the closed position can be limited.

Figure 5B:
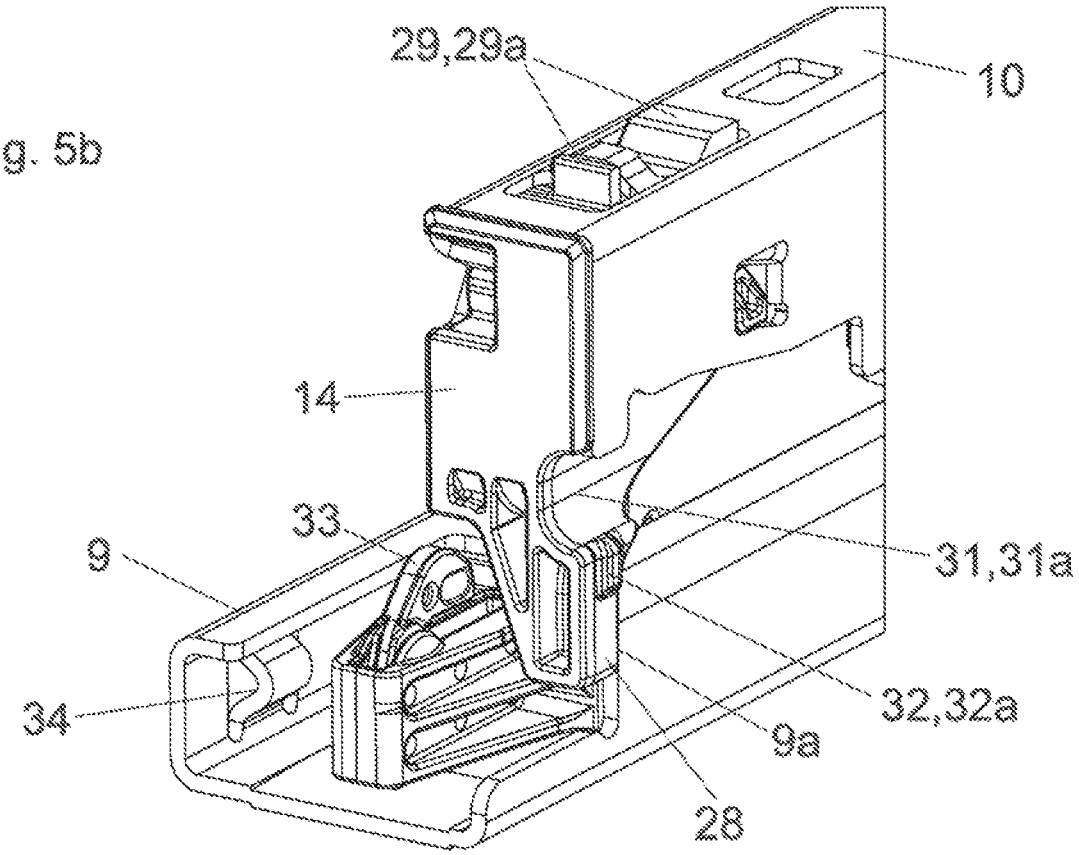

FIG. 5*b* shows the framed region of FIG. 5*a* in an enlarged view, in which the coupling device 29 with the two coupling portions 29*a* are visible. The two coupling portions 29*a* protrude upwardly from an upper side of the extension rail 10 and engaging into the carrier rail 35 (FIG. 6*a*) of the drawer 3. A displacement of the drawer 3 relative to the extension rail 10 in the longitudinal direction (L) is prevented or limited by the arrangement of the rear hook portion 13 and the front coupling portions 29*a*. The lift-off protection device 31 of the functional unit 14 includes a, for example half-cylindrical, recess 31*a* into which a holding nose 36 (not shown here, see FIG. 6*b*) of the carrier rail 35 engages. By the holding nose 36, a movement of the drawer 3 relative to the extension rail 10 in a height direction can be prevented or limited. The recess 31*a* is configured so as to be open to the front, so that a holding nose 36 (FIG. 6*b*) of the carrier rail 35, when the drawer 3 is mounted to the extension rail 10, can be inserted from the front into the recess 31*a* of the functional unit 14.

Moreover, the functional unit 14 is provided with a device 32 for the relative, preferably lateral, positioning of the drawer 3 relative to the extension rail 10. It is preferably provided that the device 32 includes at least one protrusion 32*a* configured to bear against a carrier rail 35 connected to the drawer 3. The protrusion 32*a* may optionally also configured so as to be resilient, so that the drawer 3, preferably in at least one direction extending transversely to the longitudinal direction (L), can be arranged relative to the extension rail 10 without clearance.

An actuating device 33 of a compensation device 30 is arranged on the front end of the central rail 11. The compensation device 30 is provided for compensating for a malposition, deviating from a predefined relative position, of the at least one extension rail 10 and/or of the at least one running carriage 21 of the drawer pull-out guide 4. The actuating device 33 is configured to be actuated by the abutment portion 30*a* of the functional unit 14 shown in FIG. 4*b*, and the actuating device 33 of the compensation device 30 compensates for the malposition upon an actuation by the abutment portion 30*a*.

A rail stop 34 in form of an embossment is arranged on the front end of the carcass rail 9, and the rail stop 34 is configured to limit an extension movement of the first running carriage 42 (FIG. 9*a*) which is displaceably arranged between the carcass rail 9 and the central rail 11.

Figure 6A:
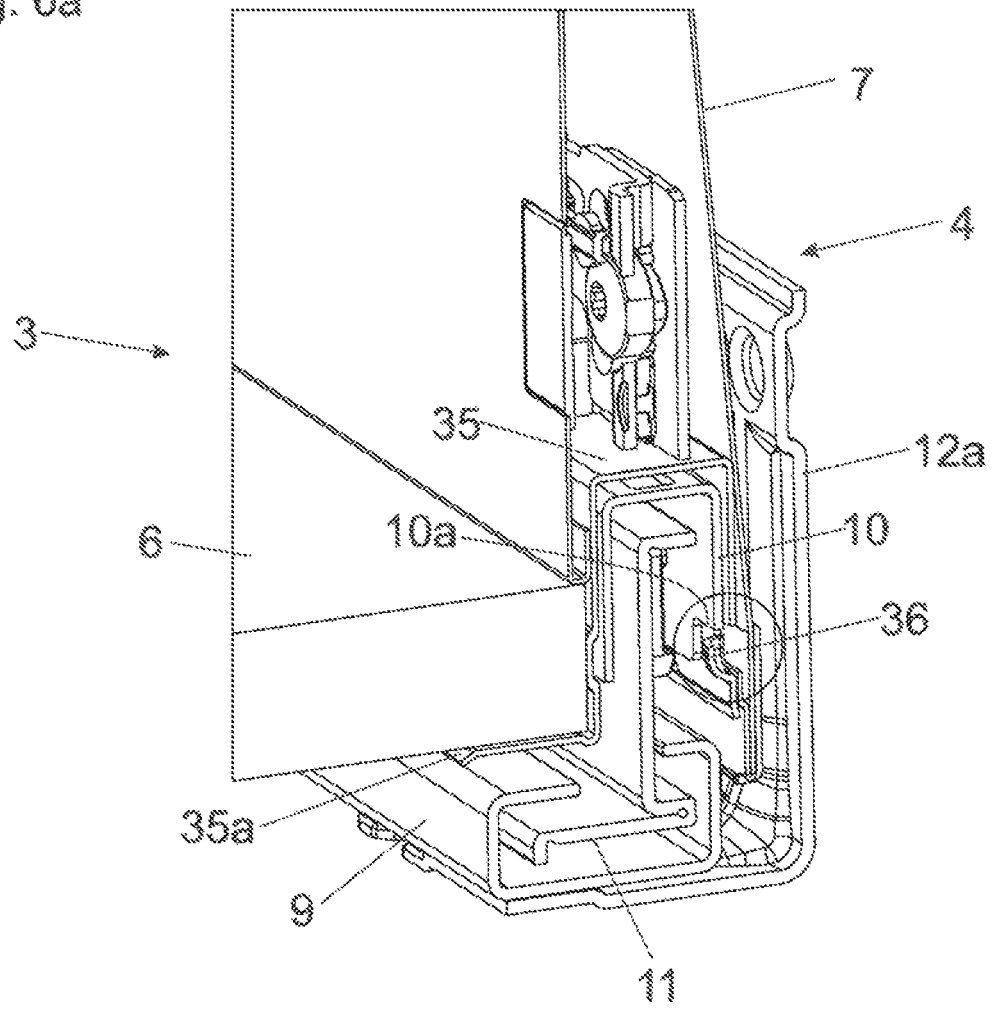
FIG. 6*a*, 6*b* show the front-end region of the drawer and an enlarged detail view thereof.
Figure 6B:
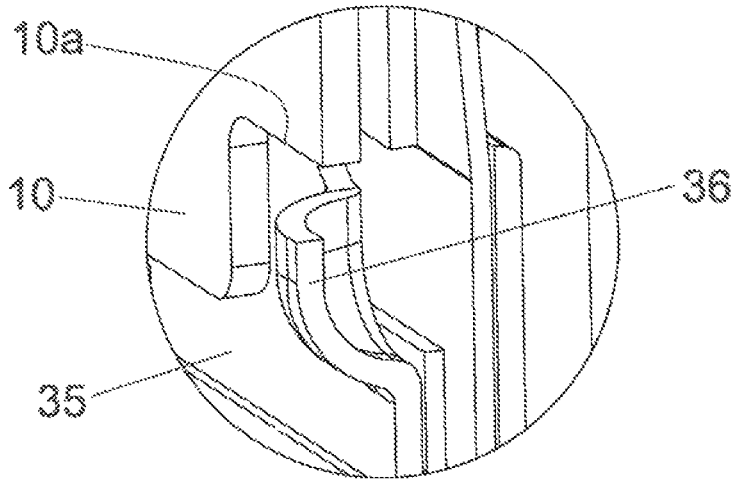

FIG. 6*a* shows a front partial region of the drawer 3 in a perspective view. The carcass rail 9 of the drawer pull-out guide 4 is to be fixed to the furniture carcass 2 via the fastening portion 12*a*. The central rail 11 and the extension rail 10 are displaceably supported relative to the carcass rail 9. The sidewall 7 of the drawer 3 is connected to the carrier rail 35, the carrier rail 35 having a support portion 35*a* for supporting the drawer bottom 6. The front-end region of the extension rail 10 is configured to be releasably coupled relative to the carrier rail 35 by the coupling device 29 of the functional unit 14, the coupling portions 29*a* engaging in corresponding recesses of the carrier rail 35. The carrier rail 35 includes a holding nose 36, preferably in the form of an embossing, engaging into a recess 10*a* of the extension rail 10, so that a movement of the drawer 3 in a height direction relative to the extension rail 10 can be prevented or limited. The holding nose 36 of the carrier rail 35, in the mounted position, is received within the recess 31*a* (FIG. 5*b*) of the functional unit 14. FIG. 6*b* shows the encircled region of FIG. 6*a* in an enlarged view.

Figure 7A:
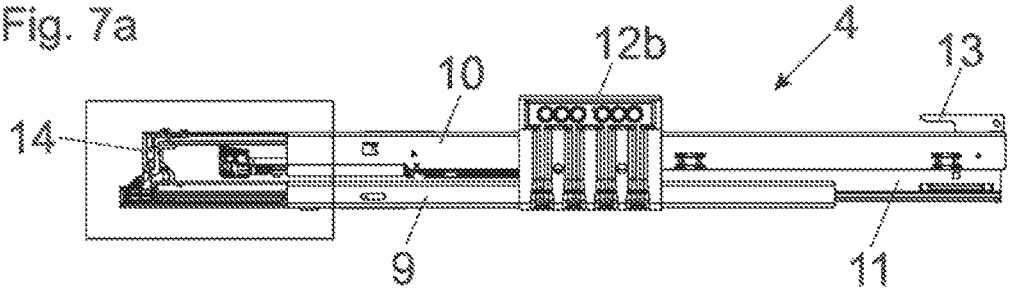
FIG. 7*a*-7*d* show a side view of the drawer pull-out guide and enlarged detail views thereof.
Figure 7B:
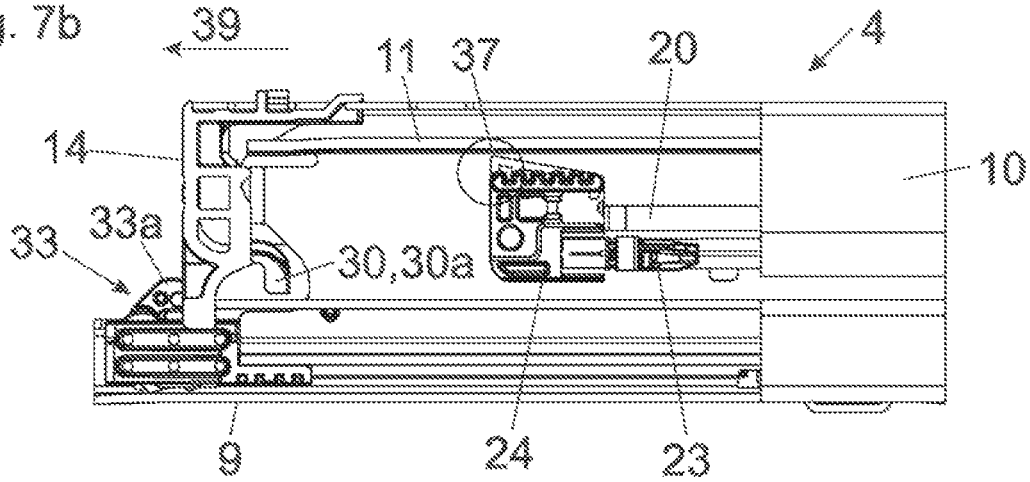
Figure 7C:
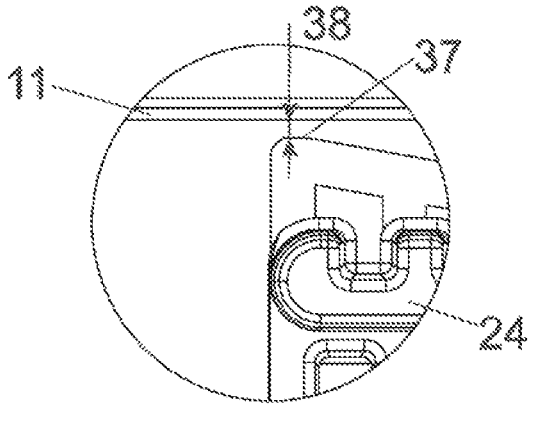

FIG. 7*a* shows the drawer pull-out guide 4 in a side view. FIG. 7*b* shows the framed, front-end region of the drawer pull-out guide 4 of FIG. 7*a* in an enlarged view. The actuating device 33 is arranged on the front-end region of the central rail 11. The actuating device 33 includes a movably-mounted actuating element 33*a* configured to be actuated by the abutment portion 30*a* of the functional unit 14 upon a movement of the extension rail 10 in the extension direction. The actuating element 33*a* can be pivotally arranged on the front end of the central rail 11, about an axis extending in a horizontal direction in the mounted position. The bearing portion 24 is fixed to the extension rail 10, and the force storage member 20 of the retraction device 17 and the housing of the damping device 23 are jointly supported on the bearing portion 24. The bearing portion 24 includes a, preferably line-shaped, supporting surface 37 which, below a predetermined load of the extension rail 10, is spaced from the central rail 11 by the formation of a gap 38. This situation is illustrated in FIG. 7*c* in which the encircled region of FIG. 7*b* is shown in an enlarged view.

Figure 7D:
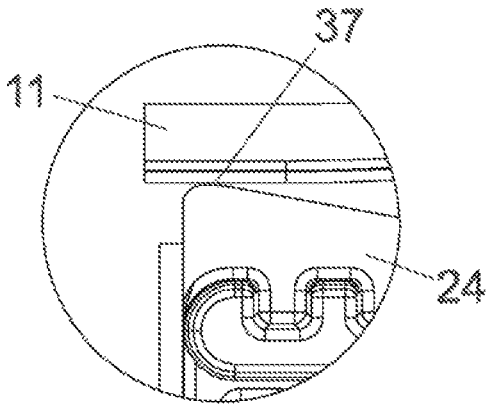

When the predetermined load of the extension rail 10 is exceeded, for example by loading the rear end portion of the drawer 3 with storage goods, the front end portion of the extension rail 10 is tilted in an upward direction, due to the presence of the second running carriage 21 arranged between the central rail 11 and the extension rail 10. The second running carriage 21 acts as a pivot bearing, so that the supporting surface 37 of the bearing portion 24 abuts against the central rail 11 so as to prevent a further pivoting movement of the extension rail 10 can be prevented (FIG. 7*d*).

Figure 8A:
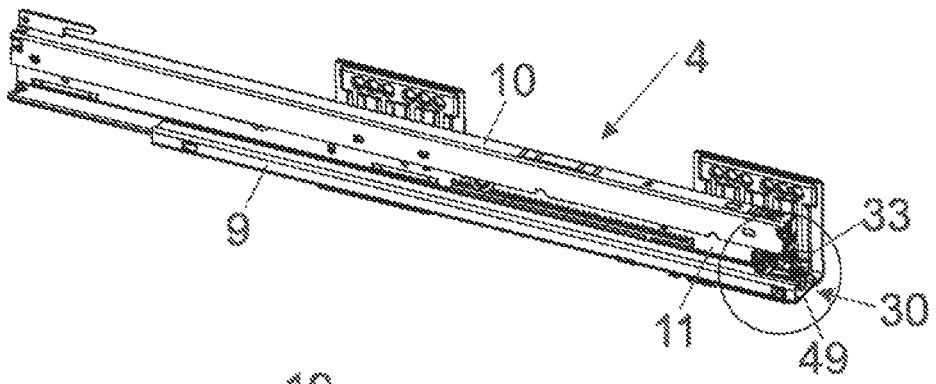
FIG. 8*a*-8*d* show the drawer pull-out guide in different views and enlarged detail views thereof.

FIG. 8*a* shows a perspective view of the drawer pull-out guide 4 located in the closed position, the drawer pull-out guide 4 including the carcass rail 9, the central rail 11 and the extension rail 10.

Figure 8B:
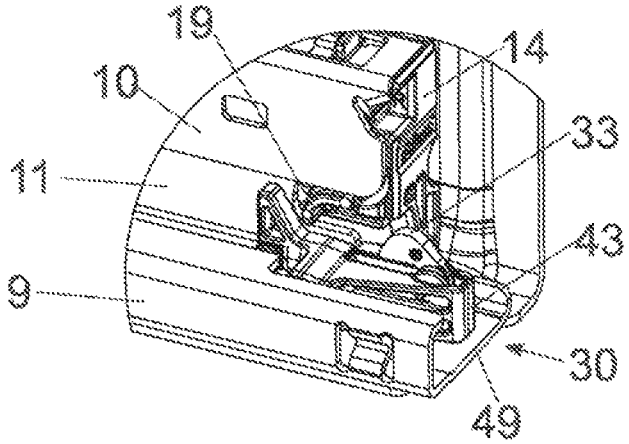

FIG. 8*b* shows the encircled region of FIG. 8*a* in an enlarged view. A bearing portion 43 with the actuating device 33 is arranged on the front end of the central rail 11. The actuating device 33 can be actuated by the abutment portion 30*a* arranged on the extension rail 10, if a malposition between the carcass rail 9, the central rail 11 and the extension rail 10 relative to one another is present.

Figure 8C:
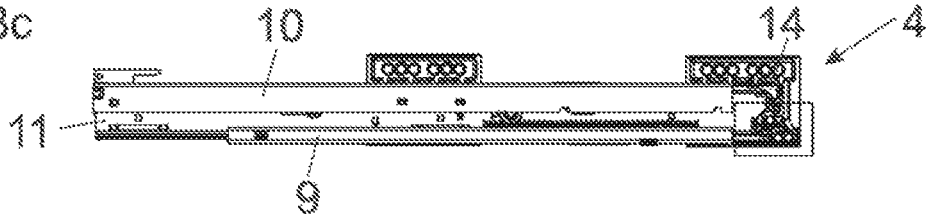
Figure 8D:
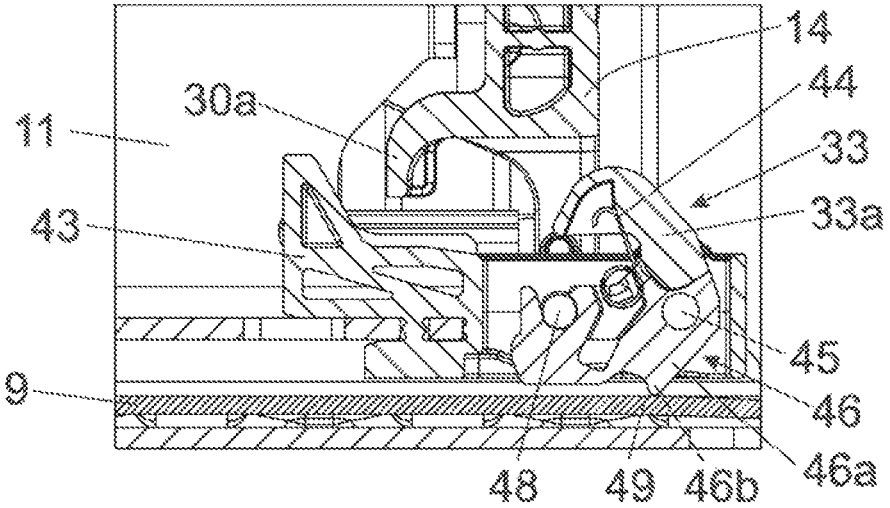

FIG. 8*c* shows a side view of the drawer pull-out guide 4. FIG. 8*d* shows the framed, front region of FIG. 8*c* in an enlarged view. The actuating device 33 includes a movably-mounted, preferably pivotable, actuating element 33*a* configured to be releasably coupled to the abutment portion 30*a* if a malposition is present. The actuating element 33, for example, can have a curved-shaped peripheral surface along which the abutment portion 30*a* can be moved at least over a region. By a switching device 46, the actuating device 33 can be switched out of engagement from the extension rail 10, preferably from the abutment portion 30*a*, if the (correct) predefined relative position of the rails 9, 10, 11 to another is present. The switching device 46 includes a movable switch element 46*a* which is preferably pivotally mounted about an axis 48, the switch element 46*a* being movement-coupled to the actuating element 33*a*. In the shown embodiment, the switch element 46*a* and the actuating element 33*a* are pivotally connected to one another by at least one moving hinge axis member 45. By a force storage member 44, the actuating element 33*a* and the switch element 46*a* are pre-stressed relative to one another such that the actuating element 33*a* and the switch element 46*a* are pushed apart relative to one another about the hinge axis member 45 by a force of the force storage member 44. The switch element 46*a* is pivotally mounted about the axis 48 and includes a protrusion 46*b* which, in the closed position of the central rail 11, bears against a blocking device 49, preferably a limb, of the carcass rail 9. By the blocking device 49, a movement of the switch element 46*a* from the first switching position into the second switching position is prevented, if a malposition of the rails 9, 10, 11 to one another is present. In FIGS. 8*a*-8*d*, the rails 9, 10, 11 adopt a correct, predefined relative position to one another.

Figure 9A:
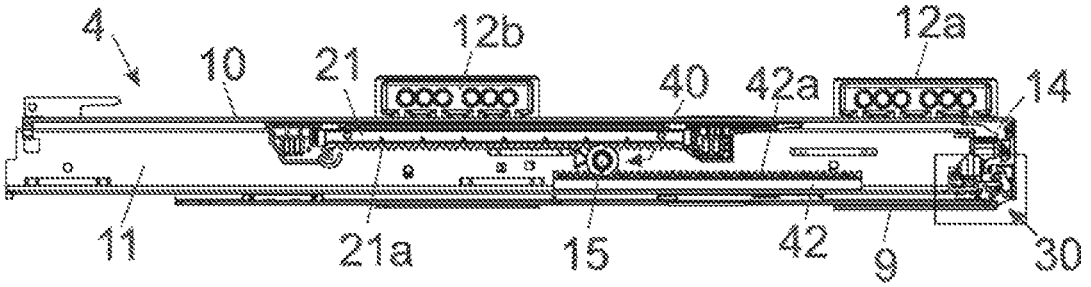
FIG. 9*a*-9*c* show the drawer pull-out guide in a cross-sectional view and two enlarged views of an extension movement of the extension rail having a correct predefined relative position.

FIG. 9*a* shows the drawer pull-out guide 4 in a cross-sectional view. A first running carriage 42 having load-transmitting rolling bodies is arranged between the carcass rail 9 and the central rail 11. A second running carriage 21 having second load-transmitting rolling bodies 21*b* (FIG. 3) is displaceably arranged between the central rail 11 and the extension rail 10. By a synchronization device 40, a motion sequence of the two running carriages 42, 21 to one another can be controlled. The synchronization device 40 includes a pinion 15 rotationally arranged on the central rail 11, the pinion 15 meshing with a first tooth arrangement 42*a* of the (lower) first running carriage 42 and meshing with a second tooth arrangement 21*a* of the (upper) second running carriage 21. In FIG. 9*a*, the extension rail 10 is located in a slight open position.

Figure 9B:
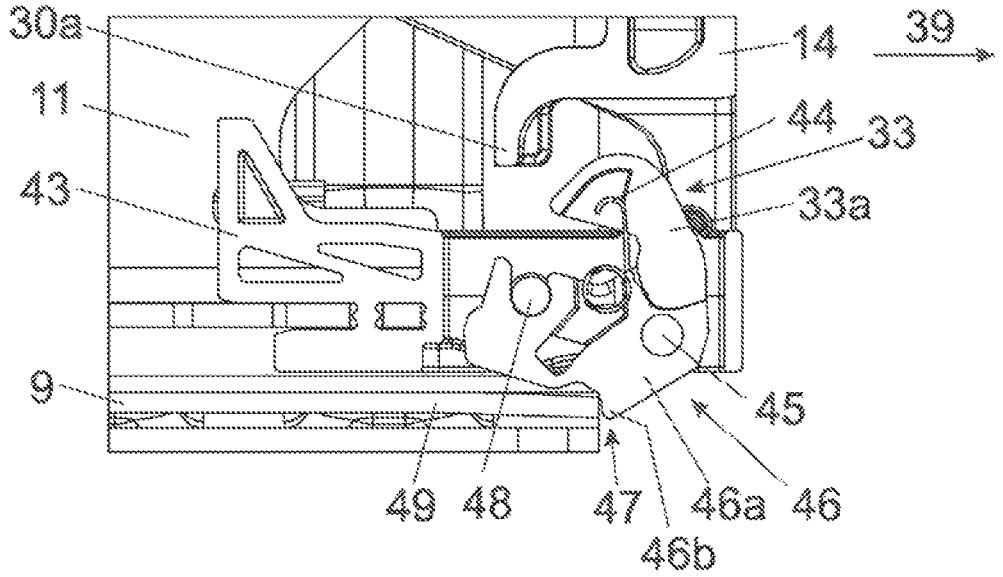
Figure 9C:
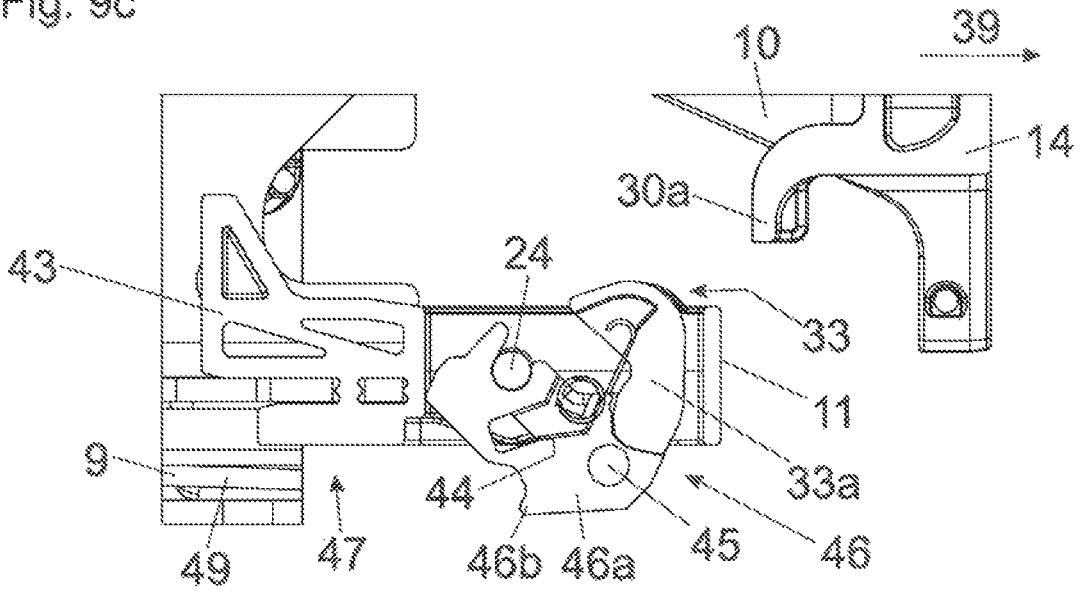

FIG. 9*b* shows the framed region of FIG. 9*a*, i.e. the front region of the drawer pull-out guide 4 in an enlarged view in which the compensation device 30 is shown in greater detail. In the shown FIGS. 9*a*-9*c*, the carcass rail 9, the central rail 11 and the extension rail 10 are located in a predefined, correct relative position to one another. If the extension rail 10 is now moved, from its closed position, in the extension direction 39, the switch element 46*a* reaches into an expanded space 47. As a result, the switch element 46*a*, together with the actuating element 33*a*, is tilted about the axis 48 in a clockwise direction such that the abutment portion 30*a* arranged on the extension rail 10 can further be moved towards the open position without interference from the actuating device 33. The expanded space 47 can be configured either as a recess in the carcass rail 9, or—as shown in the Figure—can be formed by a free space located in front of the carcass rail 9, so that the protrusion 46*b* of the switch element 46*a* moves, so to say, into the void. Upon a movement of the extension rail 10 in a direction opposite the extension direction 39, the extension rail 10 can be again moved into the closed position without interference from the actuating device 33. Optionally, the actuating element 33*a* can be overrun by the abutment portion 30*a* against a force of the force storage member 44.

Figure 10A:
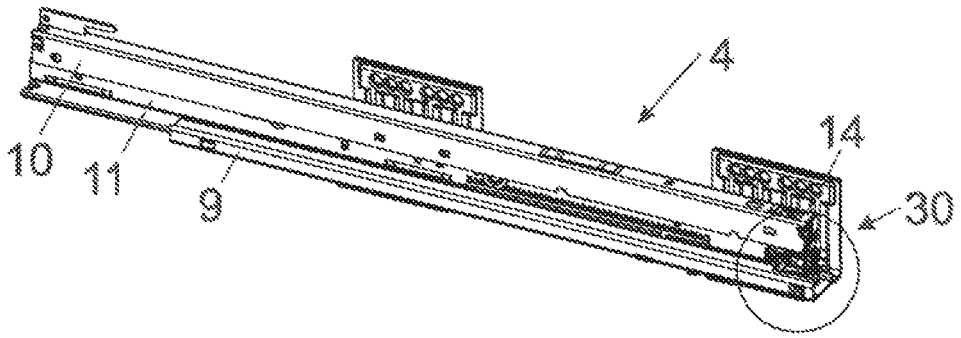
FIG. 10*a*-10*d* show the drawer pull-out guide in a perspective view and in a side view, and enlarged detail views thereof.

FIG. 10*a* shows the drawer pull-out guide 4 in a perspective view, in which the rails 9, 10, 11—for example due to a slippage occurring between the running carriages 21, 42 and the rails 9, 10, 11—adopt a malposition, deviating from the predefined relative position, to one another. This can lead, for example, to the fact that the central rail 11 is positioned too far behind in relation to the carcass rail 9, i.e. that the carcass rail 9 and the central rail 11 contact each another via a contact location 50 (FIG. 10*b*) and, as a result, a malposition to be corrected is present.

Figure 10B:
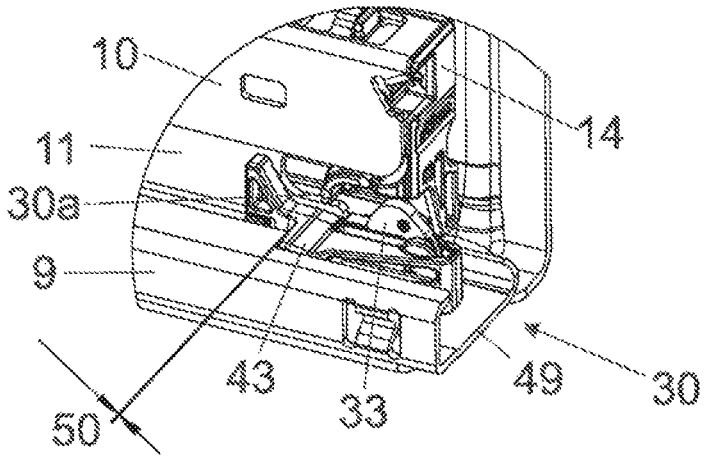
Figure 10C:
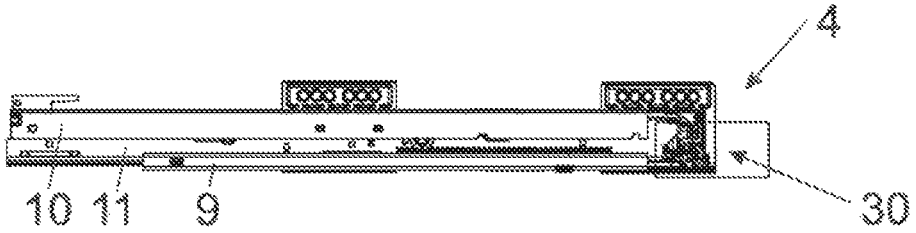
Figure 10D:
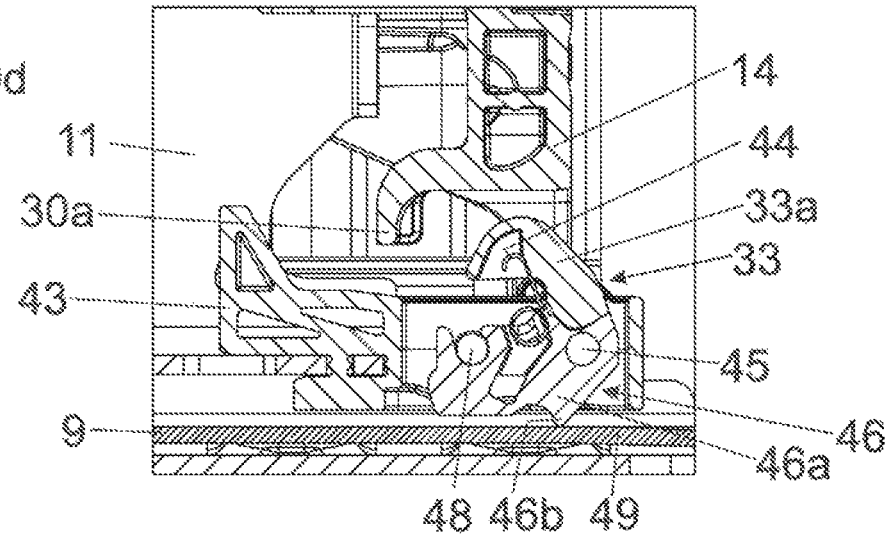

FIG. 10*b* shows the encircled region of FIG. 10*a* in an enlarged view. FIG. 10*c* shows a side view of the drawer pull-out guide 4. FIG. 10*d* shows an enlarged view of the front region of the pull-out guide 4 framed in FIG. 10*c*. In the fully closed position, the protrusion 46*b* of the switch element 46*a* bears against the blocking device 49 of the carcass rail 9. The foremost region of the limb of the carcass rail 9 can be slanted towards the front in a downward direction, whereby the friction can be reduced and the tilting behavior of the switch element 46*a* can be improved.

Figure 11A:
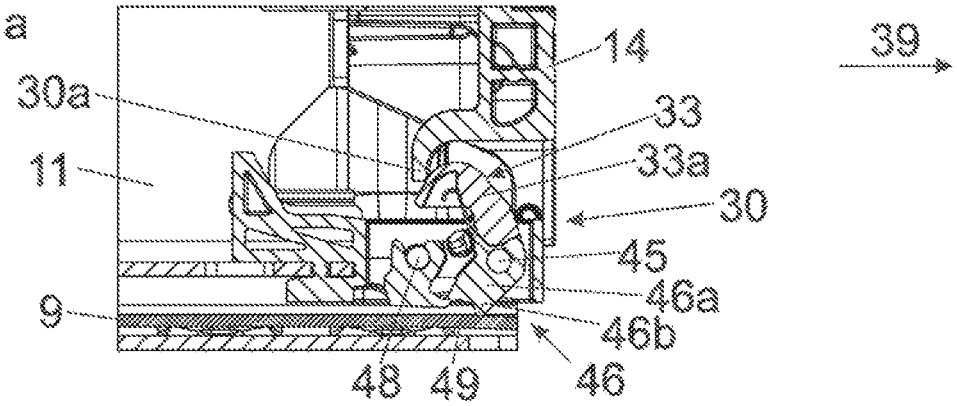
FIG. 11*a*-11*d* show a temporal sequence of the correction of a malposition of the extension rail in enlarged detail views.
Figure 11B:
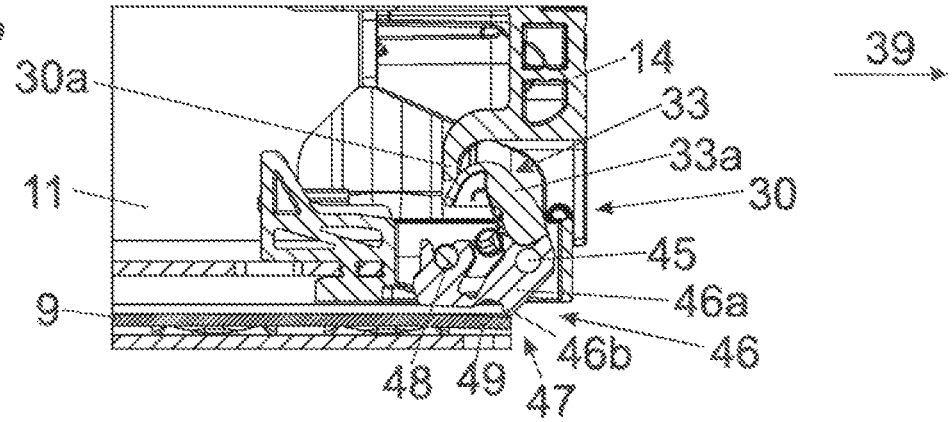
Figure 11C:
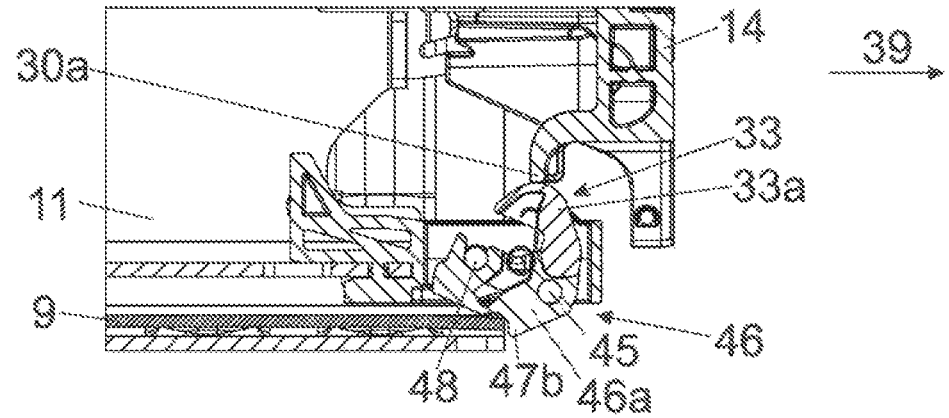
Figure 11D:
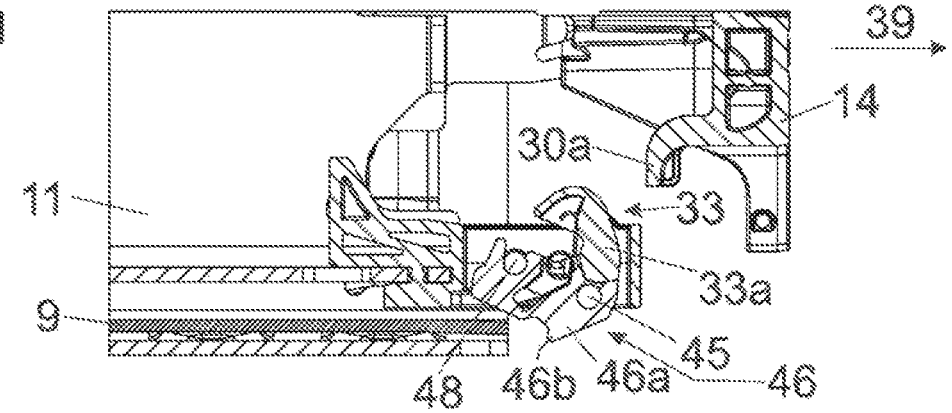

FIG. 11*a*-11*d* show a temporal sequence of the opening movement of the extension rail 10 in the extension direction 39. Starting from FIG. 10*d*, in which a malposition of the central rail 11 in relation to the carcass rail 9 is present, the actuating element 33*a* of the actuating device 33 is contacted by the abutment portion 30*a* of the extension rail 10 (FIG. 10*a*). The protrusion 46*b* of the switch element 46*a* thereby bears against the blocking device 49 of the carcass rail 9, and the blocking device 49 prevents a movement of the switch element 46*a* into a second, deactivated switching position of the switch element 46*a*. As a result, the switch element 46*a* cannot be pivoted about the axis 48. Accordingly, the extension rail 10 is thus coupled to the central rail 11 via the abutment portion 30*a* and the actuating element 33*a*. Because of the fact that the extension rail 10 moves with a higher, preferably approximately a double, speed than the central rail 11 due to the synchronization device 40 (FIG. 9*a*), the central rail 11 is temporarily coupled to the higher speed of the extension rail 10. The central rail 11 and the extension rail 10 are thus movable with a same speed relative to the carcass rail 9 upon compensating a malposition, and the central rail 11 is dragged over the rolling bodies of the first running carriage 42 (FIG. 11*b*, FIG. 11*c*). After the malposition has been corrected, the protrusion 46*b* of the switch element 46*a* can be again moved over the front end of the carcass rail 9, so that the switch element 46*a* is tilted about the axis 48 and, as a result, the coupling between the actuating element 33*a* and the abutment portion 30*a* of the extension rail 10 is released. In FIG. 11*d*, the central rail 11 has thus again reached its target position relative to the carcass rail 9.

The invention claimed is:

1. A drawer pull-out guide, comprising:

a carcass rail to be fixed to a furniture carcass;

at least one extension rail displaceably supported relative to the carcass rail between a closed position and an open position;

a retraction device having at least one force storage member, wherein the at least one extension rail can be retracted into the closed position by a force of the at least one force storage member, and wherein the retraction device is arranged within the at least one extension rail in all operating positions of the drawer pull-out guide; and a functional unit arranged on a front-end region of the at least one extension rail, wherein the functional unit and the retraction device are configured as constructional units separate from one another.

2. The drawer pull-out guide according to claim 1, wherein the functional unit is configured as a one-piece component.

3. The drawer pull-out guide according to claim 1, wherein the functional unit is at least partially arranged within the at least one extension rail.

4. The drawer pull-out guide according to claim 1, wherein the functional unit covers a front face of the at least one extension rail.

5. The drawer pull-out guide according to claim 1, wherein the drawer pull-out guide includes a central rail displaceable between the carcass rail and the at least one extension rail.

6. The drawer pull-out guide according to claim 1, further comprising a damping device for dampening a movement of the at least one extension rail into the closed position.

7. The drawer pull-out guide according to claim 6, wherein the damping device includes a piston-cylinder-unit.

8. The drawer pull-out guide according to claim 6, wherein the damping device and the at least one force storage member of the retraction device are arranged on a common bearing portion.

9. The drawer pull-out guide according to claim 8, wherein the bearing portion is fixed to the at least one extension rail.

10. The drawer pull-out guide according to claim 8, wherein the bearing portion includes at least one supporting surface for supporting a central rail displaceable between the carcass rail and the at least one extension rail.

11. The drawer pull-out guide according to claim 10, wherein the at least one supporting surface of the bearing portion is spaced from the central rail by a gap below a predetermined load of the at least one extension rail, and the at least one supporting surface of the bearing portion is configured to bear against the central rail above the predetermined load of the at least one extension rail.

12. A drawer comprising at least one drawer pull-out guide according to claim 1.

13. An item of furniture comprising a furniture carcass and at least one drawer according to claim 12, wherein the at least one drawer is displaceably supported relative to the furniture carcass by the at least one drawer pull-out guide.

14. The drawer pull-out guide according to claim 1, wherein the functional unit includes:

an end stop for stopping a movement of the at least one extension rail relative to the carcass rail in a direction of the closed position;

a coupling device for coupling the at least one extension rail to a drawer;

a compensation device for compensating for a malposition, deviating from a predetermined relative position, of the at least one extension rail or at least one running carriage of the drawer pull-out guide;

a device for a relative positioning of the drawer in relation to the at least one extension rail; or a lift-off protection device for preventing or limiting a movement of the drawer in a height direction, in a mounted condition of the drawer on the at least one extension rail.

15. The drawer pull-out guide according to claim 14, wherein the end stop protrudes transversely from the at least one extension rail and is configured to abut against a counterstop of the carcass rail in the closed position.

16. The drawer pull-out guide according to claim 14, wherein the coupling device includes at least one coupling portion which, in the mounted condition of the drawer on the at least one extension rail, is configured to engage into a recess of a carrier rail connected to the drawer.

17. The drawer pull-out guide according to claim 14, wherein:

the compensation device includes at least one abutment portion by which an actuating device of the compensation device can be actuated; and the actuating device of the compensation device is configured to compensate for the malposition upon an actuation by the at least one abutment portion.

18. The drawer pull-out guide according to claim 14, wherein the relative positioning is relative lateral positioning.

19. The drawer pull-out guide according to claim 14, wherein the device for the relative positioning of the drawer in relation to the at least one extension rail includes at least one protrusion configured to bear against a carrier rail connected to the drawer.

20. The drawer pull-out guide according to claim 14, wherein the lift-off protection device includes at least one recess configured to receive a holding nose of a carrier rail connected to the drawer, in the mounted condition of the drawer on the at least one extension rail.

* * * * *